US009927195B2

(12) United States Patent
Trulsson et al.

(10) Patent No.: US 9,927,195 B2
(45) Date of Patent: Mar. 27, 2018

(54) METHOD FOR DIRECTION LIMITATION AND SYSTEM FOR DIRECTION LIMITATION

(71) Applicant: BAE SYSTEMS BOFORS AB, Karlskoga (SE)

(72) Inventors: Per Trulsson, Vänersborg (SE); Erik Nygård, Örebro (SE); Ulf Palmlöv, Degerfors (SE); Lars-Goran Bjorn, Karlskoga (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 0 days.

(21) Appl. No.: 15/037,336

(22) PCT Filed: Nov. 12, 2014

(86) PCT No.: PCT/SE2014/000132

§ 371 (c)(1),
(2) Date: May 18, 2016

(87) PCT Pub. No.: WO2015/072901

PCT Pub. Date: May 21, 2015

(65) Prior Publication Data

US 2016/0290751 A1 Oct. 6, 2016

(30) Foreign Application Priority Data

Nov. 18, 2013 (SE) ..... 1300713

(51) Int. Cl.
*F41A 17/08* (2006.01)
*F41A 27/02* (2006.01)

(52) U.S. Cl.
CPC ..... *F41A 17/08* (2013.01); *F41A 27/02* (2013.01)

(58) Field of Classification Search
CPC ..... F41A 17/08; F41A 17/10
(Continued)

(56) References Cited

U.S. PATENT DOCUMENTS 1,942,079 A * 1/1934 Willard ..... F41G 3/14 235/405
2,436,669 A * 2/1948 Rausenberger ..... F41A 17/08 464/2

(Continued)

FOREIGN PATENT DOCUMENTS

DE 2555020 A1 6/1977

OTHER PUBLICATIONS

PCT/ISA/210—International Search Report—dated Feb. 24, 2015 (Issued in Application No. PCT/SE2014/000132).

(Continued)

*Primary Examiner* — Joshua E Freeman
(74) *Attorney, Agent, or Firm* — Venable LLP; Jeffri A. Kaminski

(57) ABSTRACT

A method for direction limitation of a firing system. A first calculating unit controls the firing system and knows direction limitation positions. An elevation of the firing system and a traverse of the firing system are measured. A position of the firing system is calculated in the first calculating unit based on the elevation and traverse. The position of the firing system is calculated in a second calculating unit based on the elevation and traverse. The calculated positions of the firing system are compared with direction limitation positions. It is decided whether the firing system is positioned outside the direction limitation positions. Also, a direction limitation system for a firing system.

14 Claims, 3 Drawing Sheets

(58) Field of Classification Search
USPC ..... 89/27.11, 41.01, 41.18, 41.02, 134
See application file for complete search history.

(56) References Cited

U.S. PATENT DOCUMENTS

| | | | | | |
|---|---|---|---|---|---|
| 2,483,385 | A * | 9/1949 | Humphrey | F41A 17/08 | 192/138 |
| 2,948,193 | A * | 8/1960 | Leathers | F41A 27/26 | 60/402 |
| 3,055,180 | A * | 9/1962 | Kane | F16H 61/40 | 60/368 |
| 3,538,318 | A * | 11/1970 | Clutterbuck | F41A 19/01 | 235/404 |
| 3,618,455 | A | 11/1971 | Mindel | | |
| 4,079,658 | A | 3/1978 | Brennan | | |
| 4,164,165 | A | 8/1979 | Bean et al. | | |
| 4,194,432 | A * | 3/1980 | Conway | F41G 5/14 | 89/41.18 |
| 4,665,795 | A * | 5/1987 | Carbonneau | F41G 3/323 | 356/139.08 |
| 5,140,329 | A * | 8/1992 | Maughan | F41G 3/142 | 342/67 |
| 6,499,382 | B1 * | 12/2002 | Lougheed | F41G 3/06 | 89/41.05 |
| 7,040,211 | B1 * | 5/2006 | Bennett | F41F 1/06 | 89/1.35 |
| 7,999,212 | B1 * | 8/2011 | Thiesen | F42B 10/64 | 244/3.1 |
| 8,434,397 | B1 * | 5/2013 | Deckard | B64D 7/06 | 89/37.13 |
| 2003/0136253 | A1 * | 7/2003 | Moser | F41G 1/00 | 89/41.17 |
| 2004/0134340 | A1 * | 7/2004 | Quinn | F41A 27/28 | 89/41.01 |
| 2006/0219094 | A1 * | 10/2006 | Padan | B64D 7/06 | 89/37.16 |
| 2009/0164045 | A1 * | 6/2009 | Deguire | G05D 1/0038 | 700/259 |
| 2013/0263731 | A1 * | 10/2013 | Allen | F41A 17/08 | 89/37.13 |
| 2015/0128823 | A1 * | 5/2015 | Akcasu | F42B 10/56 | 102/517 |

OTHER PUBLICATIONS

PCT/ISA/237—Written Opinion of the Internatioal Searching Authority—dated Feb. 24, 2015 (Issued in Application No. PCT/SE2014/000132).

* cited by examiner

METHOD FOR DIRECTION LIMITATION AND SYSTEM FOR DIRECTION LIMITATION

CROSS-REFERENCE TO RELATED APPLICATIONS

This application claims priority to Swedish patent application 1300713-3 filed 18 Nov. 2013 and is the national phase under 35 U.S.C. § 371 of PCT/SE2014/000132 filed 12 Nov. 2014.

TECHNICAL FIELD

The present invention relates to a redundant method for direction limitation of a firing system, where a first calculating unit controls the firing system and where direction limitation positions are known by the first calculating unit. The invention also relates to a direction limitation system for a firing system, comprising at least one sensor for measuring the elevation of the firing system, at least one sensor for measuring the traverse of the firing system, and a first calculating unit which controls the firing system, where the first calculating unit calculates the position of the firing system on the basis of the measured traverse and elevation, and where a first set of direction limitation positions is known by the first calculating unit.

BACKGROUND OF THE INVENTION

Problem and Prior Art

Firing systems or arrangements such as cannons, guns, missile systems or other arrangements that fire a projectile require good control of the direction of firing. Particularly when the firing systems are mounted or otherwise arranged on a craft such as a vehicle or a ship, there are directions in which a projectile cannot or must not be launched. Historically, the directions or positions in which the firing system must not be launched have been controlled by mechanical direction limitation. This direction limitation is often in the form of systems of adjustable mechanical stops which prevent, for example, a barrel from being positioned in certain positions. In these systems, the direction limitation is adjusted after the firing system has been mounted and principally involves manual work in which the barrel is positioned in a permitted position close to where a direction limitation is to be introduced, after which a mechanical stop is arranged to prevent the barrel from being positioned in positions where the firing system must not be launched. In modern systems, in which a firing system is controlled principally by electronic means with various forms of fire control systems or artillery fire control computers, the fire control system and the artillery fire control computers are also programmed with the direction limitations given by the system.

For a firing system, there are stringent and critical safety features requiring that the direction is correct and that the firing system is not positioned where there is a direction limitation. For safe use of a firing system, it is assumed that an incorrect direction occurs with a probability that is extremely low or almost non-existent. In most cases, therefore, mechanical direction limitation is combined with a direction limitation that is programmed into the fire control system or the artillery fire control computer.

Patent specification U.S. Pat. No. 4,164,165 A discloses a system which prevents launching of a firing arrangement on the basis of the position of the firing arrangement. The system includes a memory with information on safe directions, and the position of the firing arrangement is compared continuously with the safe directions. If the firing arrangement is placed in a direction where information in the memory shows that firing must not take place, the weapon is not launched. The patent specification points to the importance of safety of the system and proposes a redundant system with two parallel decoders for reading off elevation and traverse. The patent specification further describes how a comparator and error-correcting circuits are used to compare and assign the read-off values from the decoders if they show different values within a certain error tolerance. The invention described in patent specification U.S. Pat. No. 4,164,165 A does not mention direction limitation.

Further problems addressed by the invention will become clear from the following detailed description of the various embodiments.

OBJECT AND FEATURES OF THE INVENTION

The present invention improves and simplifies the direction limitation function for a firing system by using two parallel systems, preferably programmable and microprocessor-based systems, which monitor the position of the firing system and compare the actual position of the firing system with the positions where the firing system must not be positioned, also called direction limitation positions. By using two parallel systems, direction limitation can be carried out with sufficiently high precision without the need to install a physical direction limitation on the artillery. The advantages of direction limitation using a software-based system are that it is easy to change and adapt the direction limitation on the basis of the installation of the firing system and that complicated, expensive and heavy systems in the form of a physical direction limitation can be avoided. It is also possible to avoid various types of buffers or other arrangements for physically preventing an item of artillery from forcibly striking an end position.

The present invention relates to a method for direction limitation of a firing system, where a first calculating unit controls the firing system and where direction limitation positions are known by the first calculating unit, said method involving the following steps:

(a) measuring the elevation of the firing system,
(b) measuring the traverse of the firing system,
(c) calculating the position of the firing system in the first calculating unit on the basis of the measured elevation and traverse,
(d) calculating the position of the firing system in a second calculating unit on the basis of the measured elevation and traverse,
(e) comparing the calculated positions of the firing system with direction limitation positions,
(f) deciding whether the firing system is positioned outside the direction limitation positions.

According to further aspects of the improved method for direction limitation:

direction limitation positions consist of a first set of direction limitation positions for the first calculating unit and a second set of direction limitation positions for the second calculating unit;

the first set of direction limitation positions is arranged in the first calculating unit;

the second set of direction limitation positions is arranged in the second calculating unit;

the first calculating unit compares the position of the firing system with the first set of direction limitation positions, and the second calculating unit compares the position of the firing system with the second set of direction limitation positions;

the first calculating unit is an artillery fire control computer;

the second calculating unit is a servo control unit;

a third set of direction limitation positions is arranged and modifiable in the first calculating unit.

The invention also relates to a direction limitation system for a firing system, comprising at least one sensor for measuring the elevation of the firing system, at least one sensor for measuring the traverse of the firing system, and a first calculating unit which controls the firing system, where the first calculating unit calculates the position of the firing system on the basis of the measured traverse and elevation, and where a first set of direction limitation positions is known by the first calculating unit, where the firing system is directionally limited by the first calculating unit comparing the position of the firing system with the first set of direction limitation positions, and a second calculating unit, where the second calculating unit measures traverse and elevation, comparing the position of the firing system with a second set of direction limitation positions.

According to further aspects of the improved positioning system for firing equipment:

a first sensor for measuring elevation and a first sensor for measuring traverse are arranged in the first calculating unit, and a second sensor for measuring elevation and a second sensor for measuring traverse are arranged in the second calculating unit;

the first calculating unit is an artillery fire control computer;

the second calculating unit is a servo control unit.

The invention also relates to a firing system with a direction limitation system.

The invention also relates to a craft with a firing system.

Advantages and Effects of the Invention

By virtue of the proposed method for direction limitation and the proposed direction limitation system, a simpler system for direction limitation is obtained in comparison with conventional solutions. By using sensors already present in the ordnance, the position of the gun barrel can be determined by the ordnance computer belonging to the ordnance and by calculation redundancy with the servo system arranged on the ordnance. The simplification in comparison with using a conventional direction limitation system is that the complexity, cost, weight and size of the system are reduced, and that the installation of the firing system is easier with the new improved method for direction limitation and the new improved direction limitation system.

BRIEF DESCRIPTION OF FIGURES

The invention is described in more detail below with reference to the attached figures, in which.

DETAILED DESCRIPTION OF EMBODIMENTS

A system or a method for direction limitation is a safety arrangement or a safety method for a firing system. The purpose of limiting the direction of a firing system is to prevent the firing system from launching a projectile in an unsuitable direction. Since the firing system can be mounted on a craft such as a ship, a vehicle or an aircraft/helicopter, unsuitable directions can consist of positions where the ship, the vehicle or the aircraft/helicopter may be damaged by a launched projectile or may be damaged by the shockwaves, fumes or heat from a launched projectile, for example from a rocket engine. Other unsuitable directions consist of directions near or beyond the end positions of the system.

The firing system can consist of various weapons using barrels, but also of systems for missiles, rockets or unmanned aerial vehicles. The projectiles that are launched from the firing system can consist, for example, of projectiles for weapons using barrels, but also of missiles, rockets or unmanned aerial vehicles.

Figure 1:
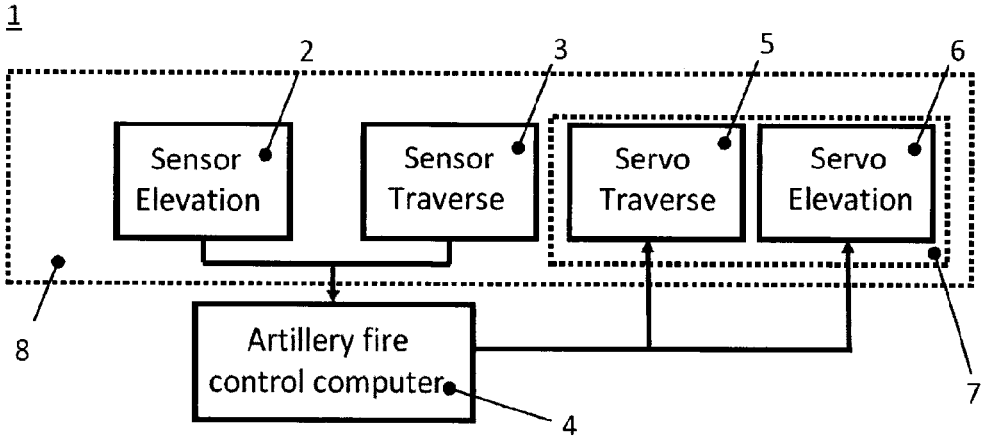
FIG. 1 shows a block diagram of a direction limitation system on a firing system according to an embodiment of the invention.

FIG. 1 shows a block diagram of a direction limitation system 1, where an elevation sensor 2 and a traverse sensor 3 measure the position of the firing system. If the firing system is a barrel-based system, the elevation thus consists of a rotatable axle in the horizontal plane and the traverse consists of a rotatable axle in the vertical plane. The elevation sensor 2 can consist of a single sensor or a plurality of redundant sensors, in the same way as the traverse sensor 3 can consist of a single sensor or a plurality of redundant sensors. The sensors preferably used are various types of angle sensors. The firing system is positioned with a motor or another actuator and, if appropriate, various types of gearboxes or other transmission arrangements for the actuator, specifically a servo, which moves the firing system in traverse and in elevation. Traverse is positioned with a servo traverse 5 and elevation is positioned with a servo elevation 6. An artillery fire control computer 4 is used to monitor the firing system. The artillery fire control computer 4 can read off the position of the firing system with elevation sensor 2 and traverse sensor 3 and can control the position of the firing system with servo traverse 5 and servo elevation 6. Servo traverse 5 and servo elevation 6 together constitute a motor control electronics unit 7. The motor control electronics unit 7 also includes sensors (not shown in the figure) for reading off the traverse and elevation of the firing system. When the firing system is a barrel-based weapons, the servo and sensors are mounted on the weapon platform 8.

Figure 2:
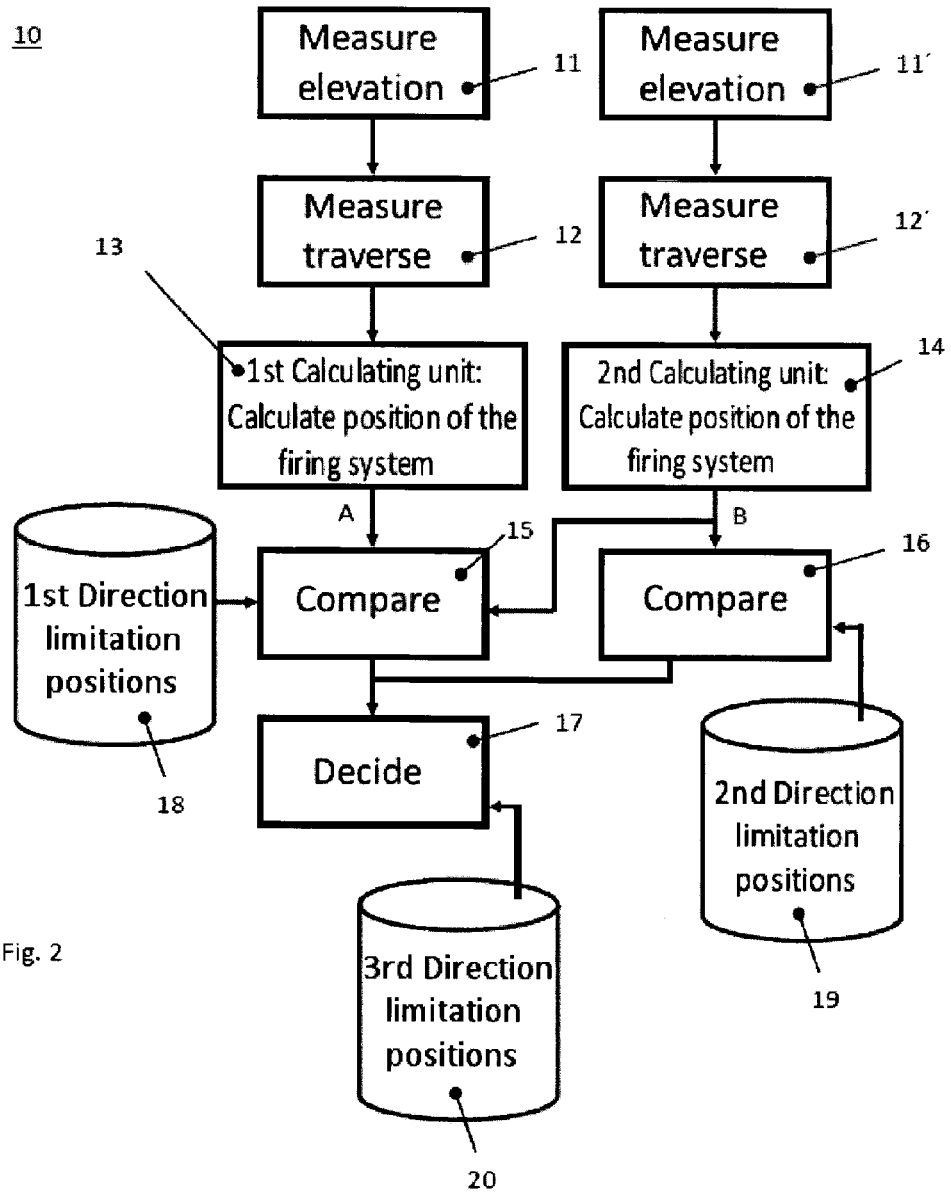
FIG. 2 shows a flow chart of a method for direction limitation according to an embodiment of the invention.

FIG. 2 shows a flow chart of a method 10 for direction limitation. The method 10 for direction limitation is initiated by the elevation being measured 11, after which a traverse measurement 12 is performed. The reverse is also possible with traverse being measured before elevation, or traverse and elevation can be measured simultaneously. In parallel with the first calculating unit 13 calculating the position of the firing system, the second calculating unit 14 calculates the position of the firing system on the basis of the measured elevation 11 and measured traverse 12'. Measurement of elevation 11, 11' can take place with a common sensor, but it preferably takes place with two separate or additional sensors, in the same way as measurement of traverse 12, 12' preferably takes place with two separate or additional sensors.

On the basis of the two calculations 13, 14 of the position of the firing system, a comparison is made with direction limitation positions 18, 19 in the compare blocks 15, 16. Positions for direction limitation are stored in a database or are available in some other way in the form of direction limitation positions 18, 19. The direction limitation positions 18, 19 indicate the permitted positioning range or which positions are permitted. The first set of direction limitation positions 18 indicates a position range within which the firing system can be positioned. The position A of the firing system, calculated by the first calculating unit, is compared with the first set of direction limitation positions 18 in the compare block 15. If the positioning of the firing system is outside the direction limitation positions 18 indicated for the system by the first set, a decision 17 can be made that the system may not be moved any further. In the same way, the position B of the firing system, as calculated by the second calculating unit, is compared with the second set of direction limitation positions 19 in the compare block 16. If the positioning of the firing system is outside the direction limitation positions 19 indicated for the system by the second set, a decision 17 can be made that the system may not be moved any further. The first set of direction limitation positions 18 is preferably more limited than the second set of direction limitation positions 19. The first set of direction limitation positions 18 and the second set of direction limitation positions 19 are specified by the manufacturer and relate principally to the limits of the firing system. The second set of direction limitation positions 19 is near the physical limits of the firing system, the first set of direction limitation positions 18 is near the second set of direction limitation positions 19 but with a slightly smaller position range. Moreover, a third set of direction limitation positions 20 is programmed into the artillery fire control computer 4 at the time of installation of the firing system. The third set of direction limitation positions 20 includes prohibited areas. The positioning range in the third set of direction limitation positions 20 is thus less than the first set of direction limitation positions 18 and therefore also the second set of direction limitation positions 19. The decision 17 on whether the system may not be moved also takes account of the third set of direction limitation positions 20. The third set of direction limitation positions 20 is modifiable and arranged in the artillery fire control computer 4. Which position range the various sets of direction limitation positions 18, 19 and 20 have is freely variable and adapted on the basis of platform and requirements.

Figure 3:
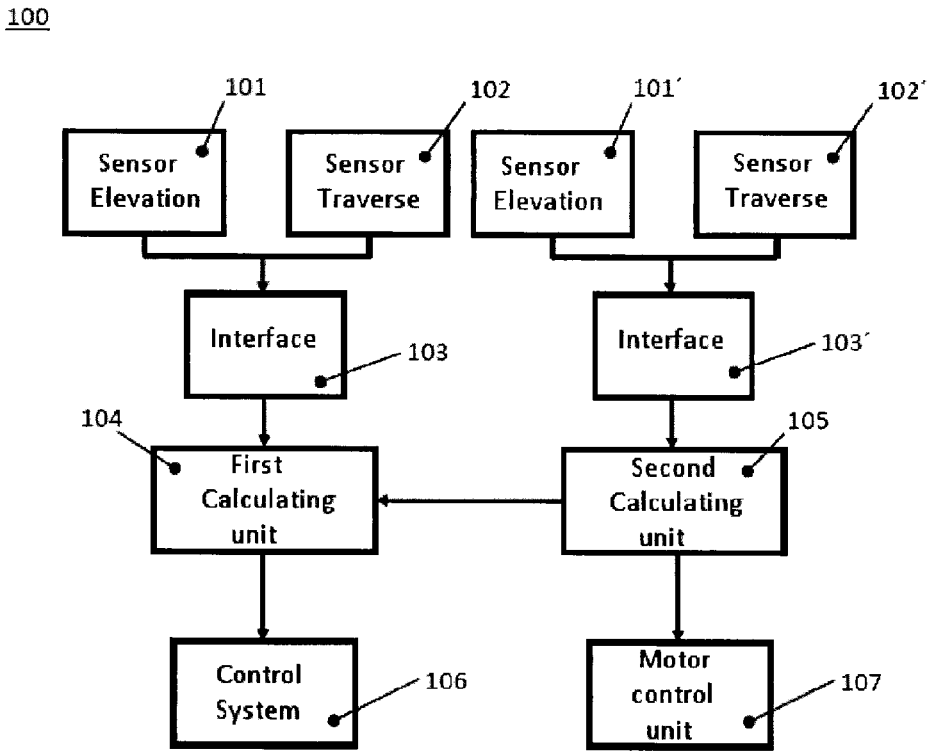
FIG. 3 shows a block diagram of components in a direction limitation system on a firing system according to an embodiment of the invention.

FIG. 3 shows a block diagram of system components in a system 100 for direction limitation. At least a first sensor 101 for elevation measurement and at least a first sensor 102 for traverse measurement are provided, with an interface 103 to a first calculating unit 104. The first calculating unit 104 preferably consists of programmable and microprocessor-based equipment, for example an artillery fire control computer. In the first calculating unit 104 there is a first set of direction limitation positions which indicates within which position range the barrel can be positioned. Moreover, there is a second sensor 101" for elevation measurement and a second sensor 102' for traverse measurement. The first sensor 101 for elevation measurement and the second sensor 101' for elevation measurement are preferably different sensors, although they can also be formed by one common sensor. In the same way, the first sensor 102 for traverse measurement and the second sensor 102' for traverse measurement are preferably different sensors, although they can also be formed by one common sensor. The second sensor 101" for elevation measurement and the second sensor 102' for traverse measurement are connected to a second calculating unit 105 by a second interface 103'. The second calculating unit 105 preferably consists of programmable and microprocessor-based equipment; for example, the second calculating unit can be part of an artillery fire control computer. In one embodiment, the second calculating unit is control equipment for the motor or the servos that position the firing system, in which case the second calculating unit is a motor control electronics unit. The second calculating unit 105 is programmed or otherwise provided with a second set of direction limitation positions. The first set of direction limitation positions is not necessarily identical to the second set of direction limitation positions. For example, the first set of direction limitation positions can contain a more limited position range, i.e. the number of available positions, compared with the second set of direction limitation positions. The second calculating unit 105 communicates or otherwise conveys the calculated positions from the second calculating unit 105 to the first calculating unit 104. The first calculating unit 104, which is part of the artillery fire control computer 4 in one embodiment, compares:

the position calculated by the first calculating unit 104, the position calculated by the second calculating unit 105, the first set of direction limitation positions, the second set of direction limitation positions, in order to determine whether the firing system has been positioned or is in the process of being positioned outside the permitted position range. Moreover, the artillery fire control computer 4 can consider the third set of direction limitation positions, which represent a direction limitation adapted to the installation of the firing system. If a prohibited positioning has taken place or is in the process of taking place, the first calculating unit can communicate with the control system 106 in order to reduce or stop the actual movement of the firing system. The second calculating unit 105, which is part of the motor control electronics unit in one embodiment, compares the positions calculated by the second calculating unit 105 with the second set of direction limitation positions. If a prohibited positioning has taken place or is in the process of taking place, the second calculating unit 105 can communicate with the motor control unit 107 in order to reduce or stop the actual movement of the firing system.

Description of Function

When being used against targets, the firing system is positioned on the basis of a fire control system which communicates with the artillery fire control computer arranged on the firing system. For positioning the firing system, the marksman, or other personnel associated with the firing system, specifies a target, from which a suitable position of the barrel is calculated. Once the main control system of the firing system, i.e. the artillery fire control computer 4, has calculated a position for the firing system, the control system, which is a part of the firing system, moves the barrel to a defined position. The control system includes an elevation sensor 2, traverse sensor 3, servo traverse 5 and servo elevation 6.

The actual process by which direction limitation is controlled is illustrated in the flow chart in FIG. 2. A first calculating unit 13, which is preferably arranged in the artillery fire control computer 4, measures and calculates continuously the position A for elevation 11 and traverse 12. A first set of direction limitation positions 18 is compared 15 continuously with the actual position A of the firing system as calculated by the first calculating unit 13. In parallel, the position B is measured and calculated on the basis of the elevation 11' and traverse 12' by a second calculating unit 14, which is preferably arranged in the control system, the motor control electronics unit 7, which controls servo traverse 5 and servo elevation 6. A second set of direction limitation positions 19 is compared 16 continuously with the actual position B of the firing system as calculated by the second calculating unit 14. The artillery fire control computer 4 carries out a comparison 15 with the first set of direction limitation positions 18 that have been specified for the firing system. The artillery fire control computer 4 also reads off the position B of elevation 11' and traverse 12' calculated by the second calculating unit 14. If the calculated position A deviates by the permitted position range according to the first set of direction limitations 18, a decision 17 can be made to interrupt the movement or positioning of the firing system. In the same way, a decision 17 can be made to interrupt the movement or positioning of the firing system if the calculated position B deviates by the permitted position range according to the second set of direction limitation positions 19. When the second calculating unit 14 is a part of the control system that positions the firing arrangement, the motor control electronics unit 7, this decision 17 can be made irrespective of whether the artillery fire control computer 4 is active. Moreover, the artillery fire control computer 4 takes account of a third set of direction limitation positions 20 where the artillery fire control computer 4, through decision 17, can interrupt or otherwise prevent the movement of the firing system if the position of the firing system approaches or reaches the position range defined by direction limitation positions 20. The third set of direction limitation positions 20 is a further position range limited by the installation of the firing system, and by the nature of the installation, compared with the first set of direction limitation positions 18 and the second set of direction limitation positions 19.

When the artillery fire control computer 4 knows the position A calculated by the first calculating unit 13 and also the position B calculated by the second calculating unit 14, a comparison 15 can be made to check that position A and position B correspond. If the calculated positions A and B differ, a decision 17 is made, where examples of measures that can be taken are to indicate the presence of a deviation or to automatically stop the artillery.

The first position range defined by the first set of direction limitation positions 18 is preferably more limited than the second position range defined by the second set of direction limitation positions 19.

Alternative Embodiments

The invention is not limited to the embodiments specifically shown and can instead be varied in a number of ways within the scope of the patent claims.

For example, it will be appreciated that the number of sensors, the firing system, or systems of the elements and components included in the method for direction limitation or in the direction limitation system are adapted according to the weapons systems and to other design properties that are present. The system and the method for direction limitation can be used for all firing equipment or other arrangements where there are strict demands in respect of reliability of positioning.

The invention claimed is:

1. A method for direction limitation of a firing system, where a first calculating unit controls the firing system and where direction limitation positions are known by the first calculating unit, said method comprising:

measuring an elevation of the firing system, measuring a traverse of the firing system, calculating a position of the firing system in the first calculating unit based on the measured elevation and traverse, calculating the position of the firing system in a second calculating unit based on the measured elevation and traverse, comparing the calculated positions of the firing system with direction limitation positions, deciding whether the firing system is positioned outside the direction limitation positions, and deciding that the firing system may not be moved any further when the firing system is positioned outside the direction limitation positions.

2. The method for direction limitation of a firing system according to claim 1, wherein direction limitation positions comprise a first set of direction limitation positions for the first calculating unit and a second set of direction limitation positions for the second calculating unit.

3. The method for direction limitation of a firing system according to claim 2, wherein the first set of direction limitation positions is arranged in the first calculating unit.

4. The method for direction limitation of a firing system according to claim 2, wherein the second set of direction limitation positions is arranged in the second calculating unit.

5. The method for direction limitation of a firing system according to claim 2, wherein the first calculating unit compares the position of the firing system with the first set of direction limitation positions, and the second calculating unit compares the position of the firing system with the second set of direction limitation positions.

6. The method for direction limitation of a firing system according to claim 1, wherein the first calculating unit is an artillery fire control computer.

7. The method for direction limitation of a firing system according to claim 1, wherein the second calculating unit is a servo control unit.

8. The method for direction limitation of a firing system according to claim 1, wherein a third set of direction limitation positions is, by the installation of the firing system, arranged and modifiable in the first calculating unit, where the third set of direction limitation positions include prohibited areas, and the decision that the system may not be moved any further takes account of the third set of direction limitation positions.

9. A direction limitation system for a firing system, comprising:

at least one sensor configured to measure an elevation of the firing system, at least one sensor configured to measure a traverse of the firing system, a first calculating unit which controls the firing system, wherein the first calculating unit calculates a position of the firing system based on the measured traverse and elevation, and wherein a first set of direction limitation positions is known by the first calculating unit, wherein the first calculating unit compares the position of the firing system with the first set of direction limitation positions and prevents movement of the firing system when the position of the firing system is outside the first set of direction limitation positions, and a second calculating unit configured to measure traverse and elevation, and compare the position of the firing system with a second set of direction limitation positions.

10. The direction limitation system according to claim 9, further comprising:

a first sensor configured to measure elevation and a first sensor for measuring traverse are arranged in the first calculating unit, and in that a second sensor for measuring elevation and a second sensor for measuring traverse are arranged in the second calculating unit.

11. The direction limitation system according to claim 9, wherein the first calculating unit is an artillery fire control computer.

12. The direction limitation system according to claim 9, wherein the second calculating unit is a servo control unit.

13. A firing system, comprising:

a direction limitation system comprising at least one sensor configured to measure an elevation of the firing system, at least one sensor configured to measure a traverse of the firing system, a first calculating unit which controls the firing system, wherein the first calculating unit calculates a position of the firing system based on the measured traverse and elevation, and wherein a first set of direction limitation positions is known by the first calculating unit, wherein the first calculating unit the position of the firing system with the first set of direction limitation positions and prevents movement of the firing system when the position of the firing system is outside the first set of direction limitation positions, and a second calculating unit configured to measure traverse and elevation, and compare the position of the firing system with a second set of direction limitation positions.

14. A craft, comprising:

a firing system comprising a direction limitation system comprising at least one sensor configured to measure an elevation of the firing system, at least one sensor configured to measure a traverse of the firing system, a first calculating unit which controls the firing system, wherein the first calculating unit calculates a position of the firing system based on the measured traverse and elevation, and wherein a first set of direction limitation positions is known by the first calculating unit, wherein the first calculating unit compares the position of the firing system with the first set of direction limitation positions and prevents movement of the firing system when the position of the firing system is outside the first set of direction limitation positions, and a second calculating unit configured to measure traverse and elevation, and compare the position of the firing system with a second set of direction limitation positions.

* * * * *